US008193475B2

(12) United States Patent
Yeung et al.

(10) Patent No.: US 8,193,475 B2
(45) **Date of Patent: *Jun. 5, 2012**

(54) HEATING APPARATUS AND METHOD FOR MAKING THE SAME

(75) Inventors: Wing Yiu Yeung, Hong Kong (CN); Keith Mario Torpy, Sydney (AU)

(73) Assignee: Advanced Materials Enterprises Company Limited, Hong Kong (HK)

( * ) Notice: Subject to any disclaimer, the term of this patent is extended or adjusted under 35 U.S.C. 154(b) by 1156 days.

This patent is subject to a terminal disclaimer.

(21) Appl. No.: 12/026,724

(22) Filed: Feb. 6, 2008

(65) Prior Publication Data

US 2008/0190912 A1 Aug. 14, 2008

Related U.S. Application Data

(60) Provisional application No. 60/900,994, filed on Feb. 13, 2007, provisional application No. 60/990,619, filed on Nov. 28, 2007.

(51) Int. Cl.
*H05B 1/02* (2006.01)
*H05B 3/22* (2006.01)
*H05B 3/26* (2006.01)

(52) U.S. Cl. ..... 219/553; 219/494; 219/541; 219/542; 219/543

(58) Field of Classification Search ..... None
See application file for complete search history.

(56) References Cited

U.S. PATENT DOCUMENTS

| | | | | |
|---|---|---|---|---|
| 4,952,783 | A * | 8/1990 | Aufderheide et al. | 219/528 |
| 5,155,340 | A * | 10/1992 | Morita et al. | 219/543 |
| 5,448,037 | A | 9/1995 | Takase et al. | |
| 5,576,885 | A * | 11/1996 | Lowe et al. | 359/585 |
| 6,242,722 | B1 | 6/2001 | Provancha et al. | |
| 6,870,139 | B2 * | 3/2005 | Petrenko | 219/482 |
| 7,034,257 | B2 * | 4/2006 | Petrenko | 219/482 |
| 7,780,438 | B2 * | 8/2010 | Hayashi et al. | 432/81 |
| 7,886,554 | B2 * | 2/2011 | Simoner | 62/248 |
| 2007/0020465 | A1 | 1/2007 | Thiel et al. | |
| 2007/0045282 | A1 * | 3/2007 | Petrenko | 219/492 |
| 2007/0292311 | A1 * | 12/2007 | Matsumoto | 422/68.1 |
| 2008/0190912 | A1 * | 8/2008 | Yeung et al. | 219/443.1 |
| 2008/0264930 | A1 * | 10/2008 | Mennechez et al. | 219/552 |
| 2009/0114639 | A1 * | 5/2009 | Werkman et al. | 219/543 |
| 2009/0194525 | A1 * | 8/2009 | Lee et al. | 219/553 |
| 2009/0235915 | A1 * | 9/2009 | Doumanidis et al. | 126/263.01 |
| 2009/0272731 | A1 * | 11/2009 | Olding et al. | 219/482 |
| 2010/0000985 | A1 * | 1/2010 | Feng et al. | 219/546 |

FOREIGN PATENT DOCUMENTS

| | | |
|---|---|---|
| WO | WO 00/18189 | 3/2000 |
| WO | 01/02621 | 1/2001 |

OTHER PUBLICATIONS

Search Report of Korean patent application No. 10-2009-7016526 and its English translation.
Second Office Action issued by the SIPO for Chinese Patent Application No. 200880004841.2.
Search Report of European patent application No. EP08706507.4.
Office Action of Chinese patent application No. 200880004841.2.

* cited by examiner

*Primary Examiner* — Joseph M Pelham

(57) ABSTRACT

A heating apparatus includes a heating element adapted to be disposed on a substrate. The heating element includes electrodes and a multi-layer conductive coating of nano-thickness disposed between the substrate and electrodes. The multi-layer conductive coating has a structure and composition which stabilize performance of the heating element at high temperatures. The multi-layer conductive coating may be produced by spray pyrolysis.

18 Claims, 8 Drawing Sheets

HEATING APPARATUS AND METHOD FOR MAKING THE SAME

CROSS-REFERENCE TO RELATED APPLICATIONS

The present application claims benefits from U.S. Provisional Patent Application No. 60/900,994 filed Feb. 13, 2007 and U.S. Provisional Patent Application No. 60/990,619 filed Nov. 28, 2007, the entire contents of which are incorporated herein by reference.

FIELD OF APPLICATION

The present application relates to a heating apparatus and a method of forming a heating element of a heating apparatus.

BACKGROUND

Low temperature conductive coating has been proposed for some time but has never been applied in a large commercial scale because of its instability, likelihood of cracking at high temperature, and expensive manufacturing costs with high vacuum vapor deposition processes needed to achieve a uniform composition and structure. Development of a uniform composition and thickness as well as a stable structure across the entire conductive layer is critical to maintain a consistent resistance and temperature distribution of the heating element of the heating apparatus. Resistance variation across the conductive layer may create temperature variation/gradient and thus thermal stress in the conductive layer, which can destabilize the structure and cause cracking of the layer, particularly in high temperature heating applications.

PCT Publication No. WO00/18189 by Torpy et al., incorporated herein by reference, has proposed a coating system by doping tin oxides with cerium and lanthanum to increase the stability of the conductive film on a glass substrate for heating purposes. However cerium and lanthanum have to be uniformly distributed within the coating to provide a stabilizing effect, which is generally difficult to achieve. A one hour annealing at a high temperature has been proposed in PCT Publication No. WO00/18189 to help create a uniform and stabilized coating. However, it is not cost effective in manufacturing and may cause detrimental diffusion of contaminant elements from the substrate into the coating. Increasing the molar percentages of cerium and lanthanum may help in the distribution of these rare earth elements, but leads to increased electrical resistance of the film. This results in reduction of conductivity and power outputs, and imposes restrictions in practical and commercial use of the film.

The above description of the background is provided to aid in understanding the heating apparatus and the method of forming a heating element of a heating apparatus disclosed in the present application, but is not admitted to describe or constitute pertinent prior art to the heating apparatus and method disclosed in the present application, or consider the cited document as material to the patentability of the claims of the present application.

SUMMARY

The present application is directed to a heating apparatus. The heating apparatus includes a heating element adapted to be disposed on a substrate. The heating element includes electrodes and a multi-layer conductive coating of nano-thickness disposed between the substrate and electrodes. The multi-layer conductive coating has a structure and composition which stabilize performance of the heating element at high temperatures.

In one embodiment, the heating element of the heating apparatus includes a multi-layer insulating coating of nano-thickness disposed between the multi-layer conductive coating and the substrate.

In another embodiment, the heating apparatus includes a temperature monitor and control system integrated with the heating element. The temperature monitor and control system includes an analog-to-digital converter for measuring temperature and a pulse-width modulation drive for regulating power supply.

In yet another embodiment, the heating apparatus includes a split chamber defining a first wind tunnel and a second wind tunnel, and a fan adapted to blow hot air out of the heating apparatus through one of the first and second wind tunnels adjacent to the substrate and the multi-layer conductive coating.

The multi-layer conductive coating of the heating element of the heating apparatus may be produced by spray pyrolysis.

The spray pyrolysis can be carried out at a temperature of about 650° C. to about 750° C.

The spray pyrolysis can be carried out at a spray pressure of about 0.4 MPa to about 0.7 MPa.

The spray pyrolysis can be carried out at a spray head speed of less than 1000 mm per second.

The spray pyrolysis can be carried out by alternating spray passes in a direction of about 90 degrees to each other.

BRIEF DESCRIPTION OF THE DRAWINGS

Specific embodiments of the heating apparatus and the method of forming a heating element of a heating apparatus disclosed in the present application will now be described by way of example with reference to the accompanying drawings wherein.

DETAILED DESCRIPTION

It should be understood that the heating apparatus and the method of forming a heating element of a heating apparatus are not limited to the precise embodiments described below and that various changes and modifications thereof may be effected by one skilled in the art without departing from the spirit or scope of the appended claims. For example, elements and/or features of different illustrative embodiments may be combined with each other and/or substituted for each other within the scope of this disclosure and appended claims.

As used herein, the term "a multi-layer coating" or "a multi-layered coating" refers to a coating having more than one layer of a coating material.

As used herein, the term "nano-thickness" refers to a thickness of each coating layer only measurable in nanometer at the nanometer level.

Figure 1:
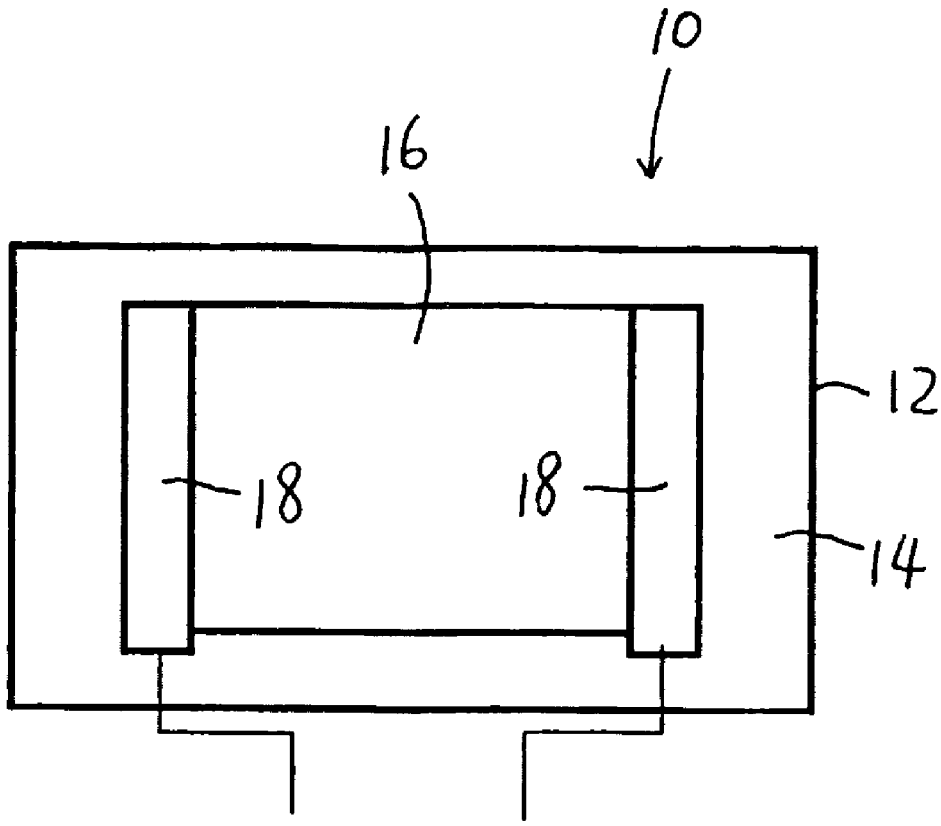
FIG. 1 is a top plan view of a heating element of a heating apparatus according to an embodiment of the present application.
Figure 2:
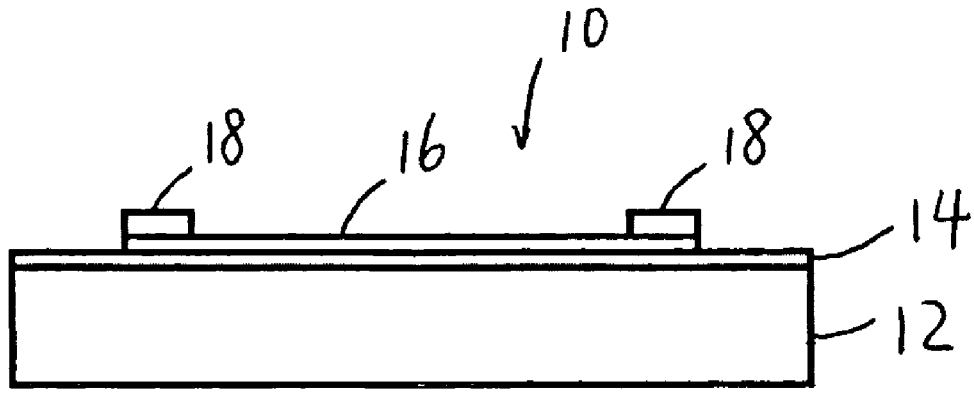
FIG. 2 is a side view of the heating element of FIG. 1.

FIGS. 1 and 2 are top and side views respectively of a heating element of a heating apparatus according to an embodiment of the present application. The heating apparatus has a heating element 10 for the generation of heat. The heating element 10 includes a substrate 12, a multi-layer insulating coating 14 disposed on the substrate 12, a multi-layer conductive coating 16 disposed on the multi-layer insulating coating 14, and electrodes 18 disposed on the multi-layer conductive coating 16.

In the illustrated embodiment, the substrate 12 is made of ceramic glass or any other suitable material. It is understood by one skilled in the art that ceramic glass can survive high temperature and thermal shock, and is often selected over other glass substrates in providing consistent and reliable high temperature heating functions.

In the illustrated embodiment, the multi-layer insulating coating 14 is disposed on a surface of the ceramic glass substrate 12. The multi-layer insulating coating 14 may be made of sol-gel derived silicon dioxide ($SiO_2$), or other suitable material. Each layer of the multi-layer insulating coating 14 has a nano-thickness of about 30 nm to about 50 nm. The multi-layer insulating coating 14 can be applied on the surface of the ceramic glass substrate 12 with a surfactant to ensure 100% wetting of the $SiO_2$ coating on the ceramic glass substrate 12 to prevent defect sites, to electrically isolate the conductive coating 16 from the ceramic glass substrate 12 (which may become conductive at high temperature), and to prevent diffusion of lithium ions and other contaminant elements migrating from the ceramic glass substrate 12 into the conductive coating 16 during heating process.

Perfluoralkyl surfactant of a concentration between about 0.01 and about 0.001% w/w may be used with sodium dioctyl sulphosuccinate of a concentration between about 0.1 and about 0.01% w/w applied on the ceramic glass substrate 12 using spraying, or dip coating technique, or other suitable techniques.

$SiO_2$ layers can be deposited on the ceramic glass substrate 12 using dip coating, or other suitable techniques, and using Tetra Ethoxy Ortho Silicate (TEOS) as the base precursor. Each sol-gel silica layer needs to be hydrolysed, dried and fired at about 500° C. using a staged ramp up temperature cycle essentially to remove physical water, chemically bound water and carbon and organic residues from the matrix, resulting in ultra pure $SiO_2$ layers with minimum defects.

Figure 3:
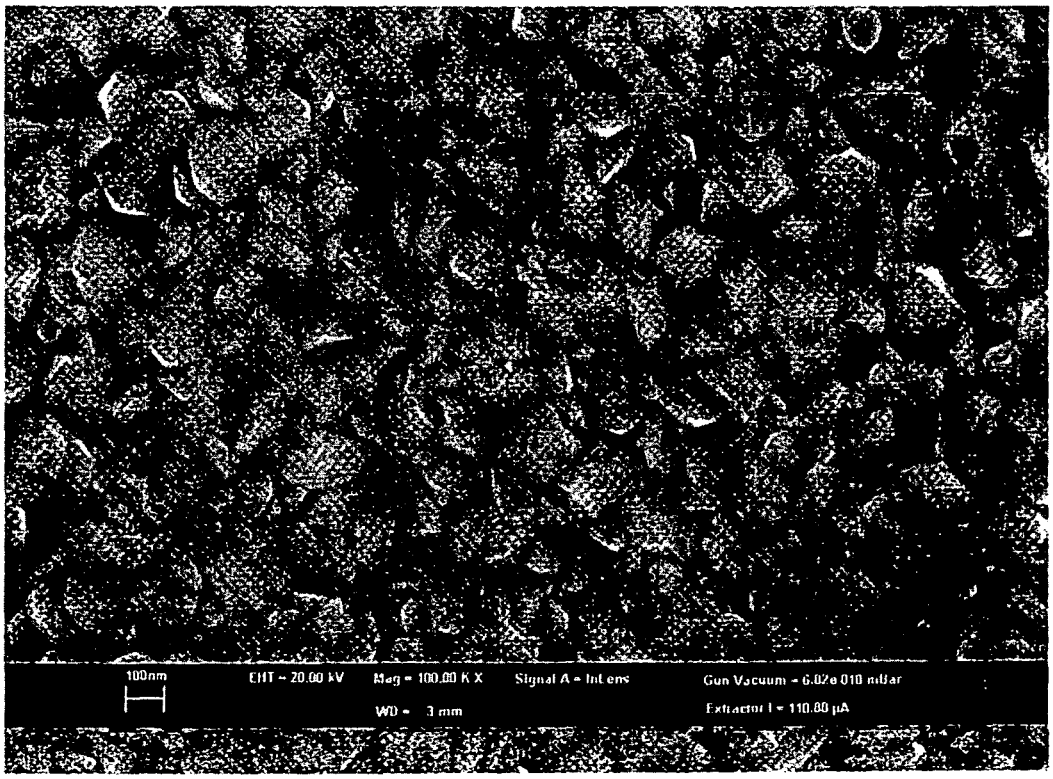
FIG. 3 is a high resolution scanning electron micrograph showing the nanostructure of a conductive coating of the heating element of FIG. 1.

In the illustrated embodiment, the multi-layer conductive coating 16 is disposed on the insulating coating 14. The multi-layer conductive coating 16 may be an oxide coating using a source metal selected from the group consisting of tin, indium, cadmium, tungsten, titanium and vanadium with organometallic precursors like Monobutyl Tin Tri-chloride doped with equal quantities of donor and acceptor elements such as antimony and zinc at about 3 mol % with or without other rare earth elements. FIG. 3 is a high resolution scanning electron micrograph showing the nanostructure of the conductive coating 16 of the heating element 10. It is understood that the multi-layer conductive coating 16 can be made of other suitable materials.

The multi-layer conductive coating 16 may be deposited over the insulating coating 14 using spray pyrolysis with controlled temperature between about 650° C. to about 750° C. at a spray pressure of about 0.4 to about 0.7 MPa, in formation of a multi-layered nano-thickness coating of about 50 to about 70 nm each layer in thickness to ensure uniform distribution of the rare earth materials within the coating leading to increased stability at high temperatures. Preferably, the controlled spray movement is in alternating spray passes in the direction of about 90° to each other. The speed of spray head is restricted to below 1000 mm per second.

The conductive coating material in the multi-layer conductive coating 16 is used to convert electric power into heat energy. The applied heat generation principle is quite different from that of a conventional coil heating in which heating outputs come from a high electrical resistance of the metal coils at low heating efficiency and high power loss. In contrast, by adjusting the composition and thickness of the coatings, electrical resistance of the coating can be controlled and conductivity can be increased to generate high heating efficiency with minimal energy loss.

In the illustrated embodiment, the electrodes 18 are disposed on the conductive coating 16. Two spaced apart electrodes 18 are formed along two opposite sides of the conductive coating 16, respectively. The electrodes 18 may be made of glass ceramic frit based ink, with a source metal selected from the group consisting of platinum, gold, silver, palladium and copper (90-95%), and glass frit (5-10%) made of PbO, $SiO_2$, $CeO_2$ and $Li_2O$ added with an organic vehicle of ethyl cellulose/ethanol. The ink may be screen printed over the conductive coating area with optimum matching between the electrodes 18, the coating 14, 16 and the ceramic glass substrate 12 in providing consistent conductivity across the coating area. The ink may be screen printed and baked at about 700° C. for about 5 minutes to form the electrodes 18 on the heating element 10. This can prevent potential delamination of the electrodes 18 from the coating 14, 16 and the substrate 12 which may cause failure of the heating element 10. No prolonged high temperature annealing is required to settle the coatings and electrodes.

Figure 4:
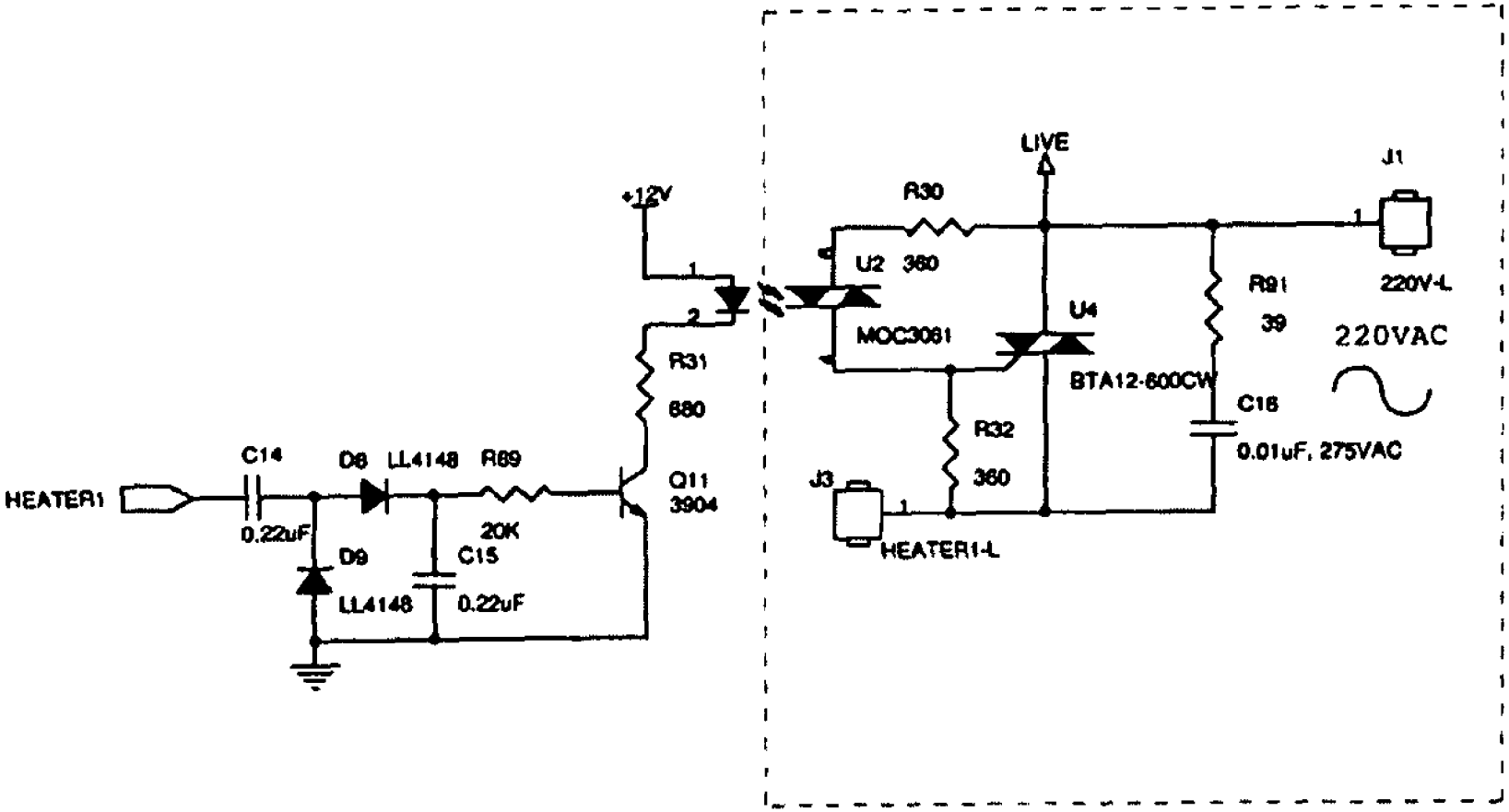
FIG. 4 is a circuit diagram showing a control unit connected to a power supply with a heating element.
Figure 5:
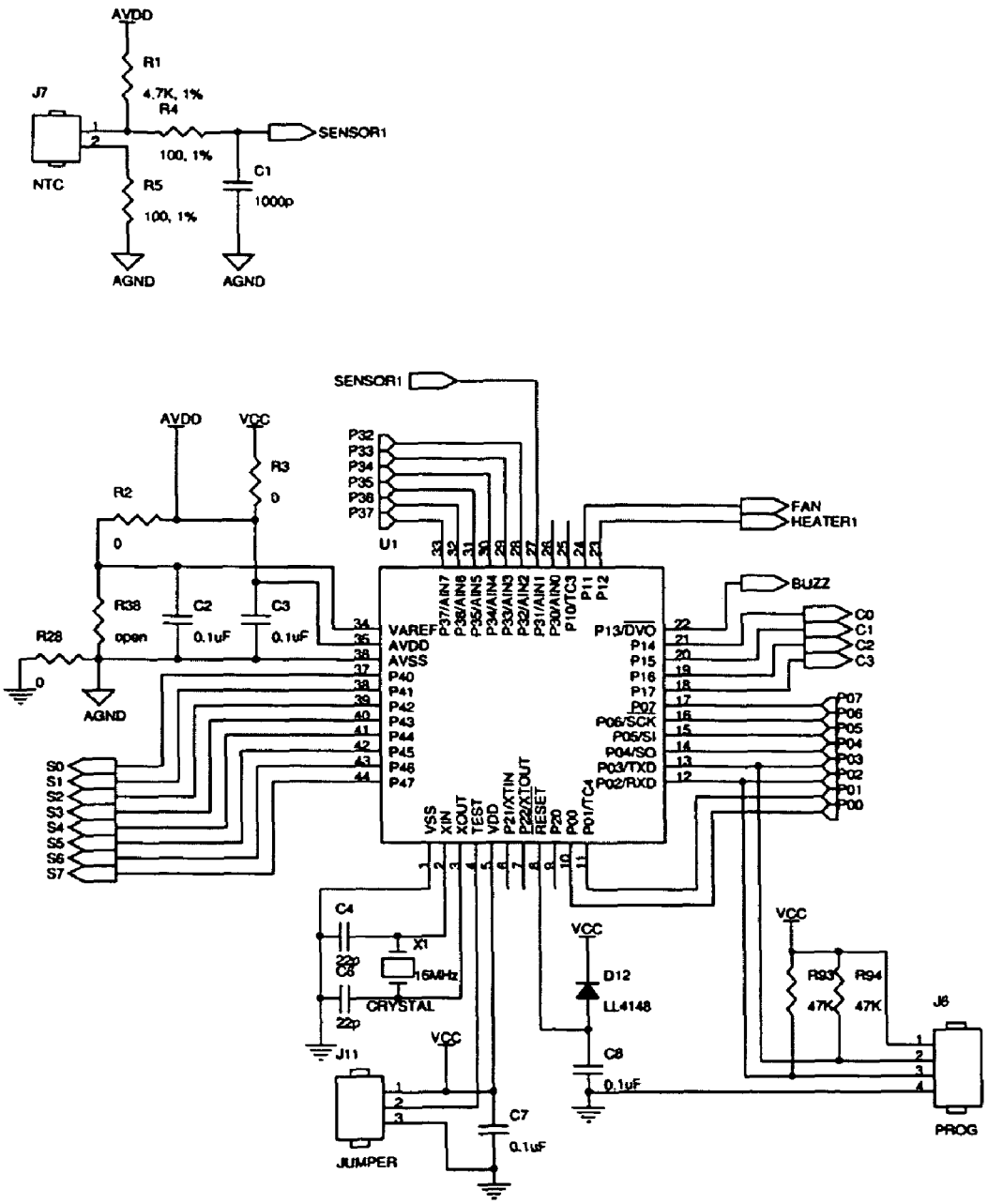
FIG. 5 is a circuit diagram of a temperature monitor and control system with an analog-to-digital converter (ADC) and a pulse-width modulation (PWM) drive.

For practical commercial and industrial uses in performing heating functions up to about 300° C. to about 350° C., the insulating coating 14 may not be required to be disposed on the surface of the ceramic glass substrate 12. Instead, a temperature monitor and control system can be integrated with the conductive coating 16 of the heating element for optimum temperature and energy saving control. In this embodiment, driving software and controller using an analog-to-digital converter (ADC) for temperature measurement and a pulse-width modulation (PWM) drive for precise power control is provided and integrated with the heating element. The circuits of the temperature monitor and control system are shown in FIGS. 4 and 5.

With this temperature monitor and control system, a heating servo system can be applied to match with and optimize the fast and efficient heating characteristics of the heating element of the heating apparatus in achieving fast heating up time (within 1 minute), accurate temperature target (+/−5° C.) and maximum energy savings (of efficiency up to 90%). When the heating element of the heating apparatus reaches the preset target temperature, the ADC and PWM will immediately respond and cut off power supply for energy saving purpose and restrict offshoot of temperature of the heating element. When the temperature of the heating element falls below the preset temperature, ADC and PWM will then respond and switch on power supply for heat generation. The servo system therefore provides continuous monitoring and controlling with fast response in smoothing the power supply to the heating element and optimizing its heating performance and energy saving efficiency.

With the coating composition, the heating element 10 of the heating apparatus can be manufactured by an inexpensive deposition method in open air environment via spray pyrolysis. In addition, application of controlled multi-spray passes in forming of the multi-layer conductive coating can minimize the application of cerium and lanthanum to an amount below the required 2.5 mol % as specified in the PCT Publication No. WO00/18189, and maintain the stability of the conductive coating in performing high temperature heating functions. Spray head movement conditions can be established and the speed is restricted to below 1000 mm per second. With the coating system on ceramic glass and the spray process conditions as specified, the heating element of the present application is capable of achieving stable and reliable performance for practical high temperature heating functions up to about 600° C. The heating element of the present application can also withstand about 2500 life test cycles of a heating time of about 40 minutes each cycle.

It is determined that spray parameters can affect the characteristics of the heating element, and optimum conditions can be established. Some examples on variation of effective resistances and power ratings (at 220V) of the heating element 10, with a coated area of 150 mm×150 mm, are provided in Tables 1, 2 and 3.

Table 1 shows variation of the effective resistances and power ratings of the heating element produced by 2, 6, 10 and 12 spray passes, at a spray head movement speed of about 750 $mms^{-1}$ and at a spray pressure of about 0.5 MPa.

TABLE 1

| | Spray Passes | | | |
|---|---|---|---|---|
| | 2 | 6 | 10 | 12 |
| Electrical Resistance (ohm) | 300 | 72 | 38 | 29 |
| Power Rating at 220 V (W) | 161 | 672 | 1273 | 1668 |

Table 2 shows variation of the effective resistances and power ratings of the heating element produced at different spray head movement speeds and at a spray pressure of about 0.625 MPa. At a spray head speed of 1000 mm per second, coating formation becomes non-uniform, and its heating performance is unstable.

TABLE 2

| | Spray Head Speed (mm/s) | | |
|---|---|---|---|
| | 250 | 750 | 1000 |
| Electrical Resistance (ohm) | 147 | 66 | non-uniform |
| Power Rating at 220 V (W) | 329 | 733 | — |

Table 3 shows variation of the effective resistances and power outputs of the heating element produced at different temperature ranges. Lower electrical resistances and hence higher power outputs can be achieved at higher temperature of about 700° C. to about 750° C.

TABLE 3

| | Coating Temperature (° C.) | |
|---|---|---|
| | 650-700 | 700-750 |
| Electrical Resistance (ohm) | 85 | 75 |
| Power Rating at 220 V (W) | 569 | 645 |

The multi-layered nano-thickness coating system disclosed in the present application has the characteristics that the coating material can be deposited by a low-cost spraying process in an open-air environment. This multi-layered nano-thickness coating system renders a heating element of a heating apparatus to maintain a stable structure and high conductivity, and hence results in consistent electrical resistance and heating performance at high temperature even for a prolonged period.

To achieve the above-mentioned result, an optimum atomization of the spraying material solution and deposition on the substrate surface are required by a specific selection of the composition and properties of the coating material of the base and doped elements, the process conditions of the spray pyrolysis covering the substrate surface, including temperature, movement of the spraying head, nozzle design, and spray pressure. The multi-layer coatings of nano-thickness with high conductivity can enhance the coating stability and minimize the risk of formation of cracks.

With the coating composition and processing described in this application, it is capable for both low and high temperature/power output heating for electrical appliances including but not limited to electrical cooktops, electrical hotplates (including laboratory hotplates), towel and clothing heated racks, electrical heaters, defrosters and warmers.

Figure 6:
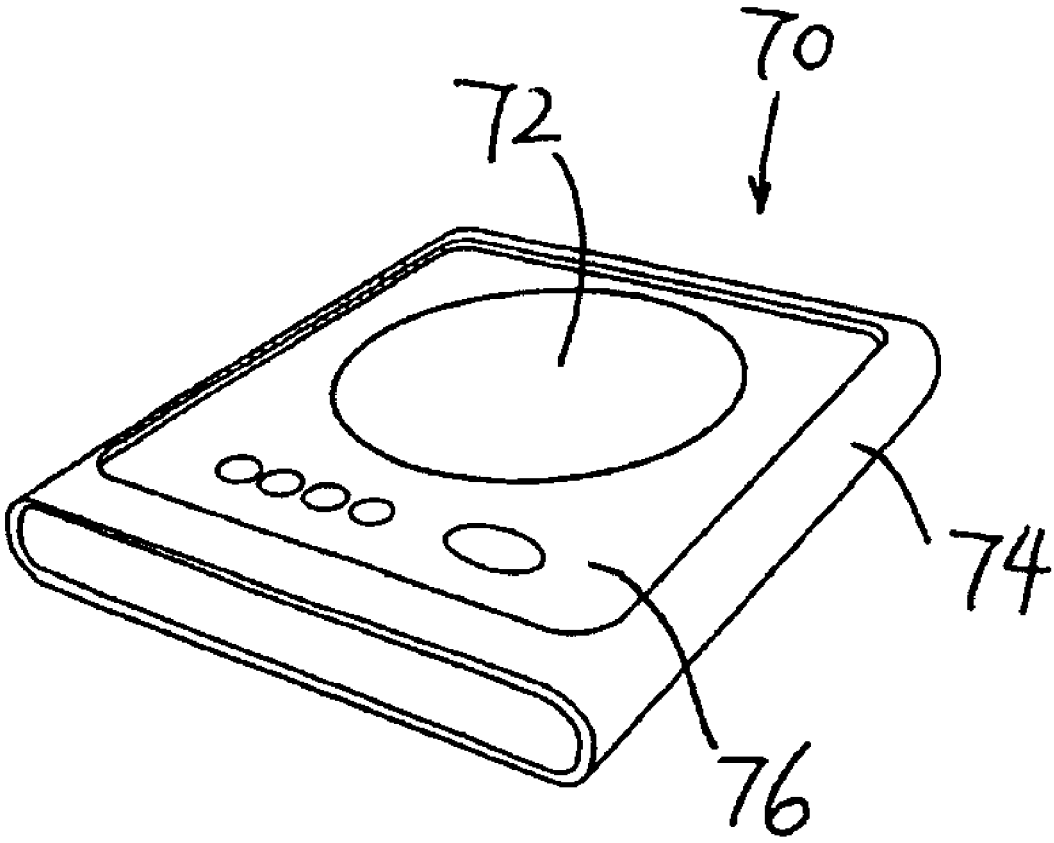
FIG. 6 is a perspective view of a heating apparatus/hotplate using the heating element according to an embodiment of the present application.

With the features of the nano-thickness heating element, a compact heating apparatus such as a hotplate 70 without a conventional heating coil, as shown in FIG. 6, having a thickness of 30 mm or less is developed. A heating element is provided at the downside of the heating zone 72. The heating zone 72 can be made of a ceramic glass. A temperature monitor and control system can be integrated with the heating element. Using the heating element with an effective resistance of about 50 ohms, an energy amount of about 0.1 KWH is needed to heat up a litre of water from 25° C. to about 95° C., increasing efficiency about 85%.

Figure 7:
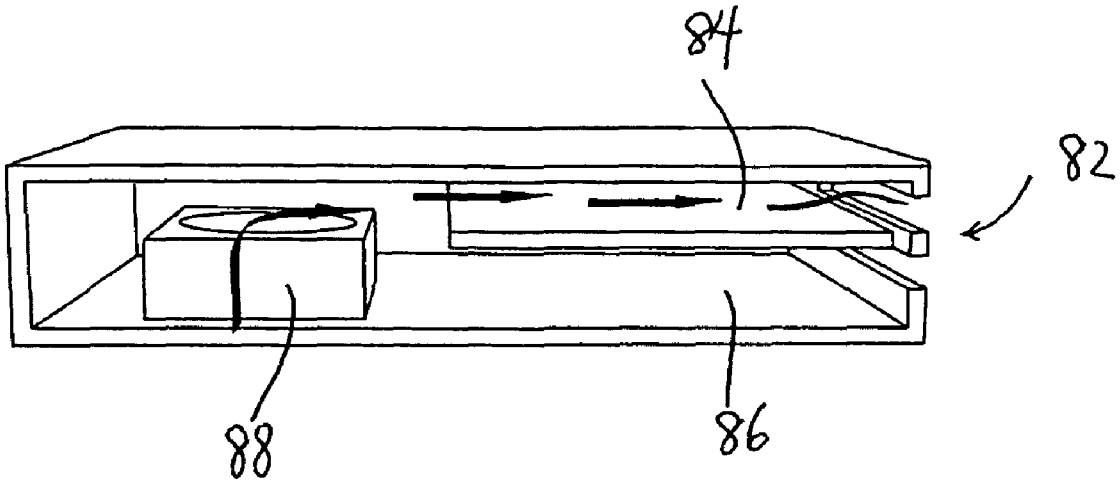
FIG. 7 is a schematic perspective view of a split chamber of the heating apparatus according to an embodiment of the present application.
Figure 8:
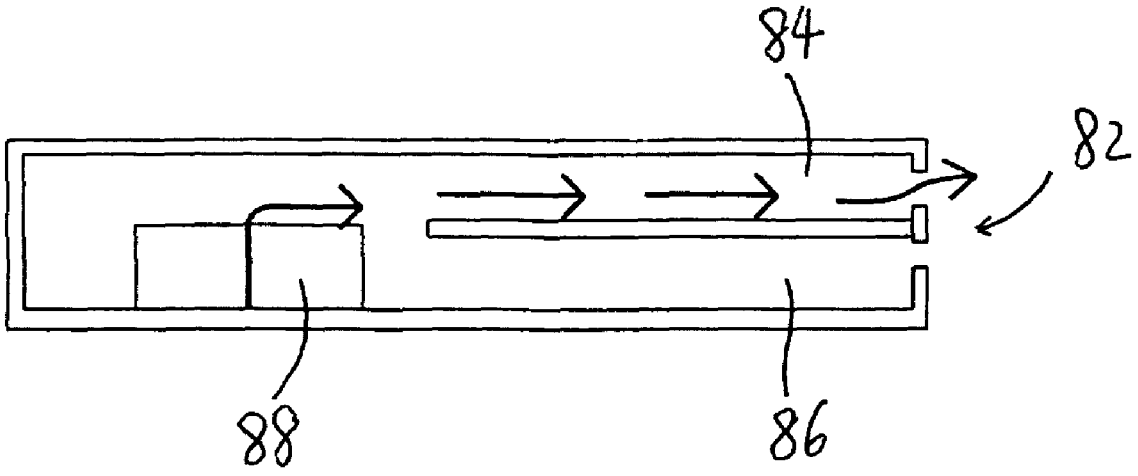
FIG. 8 is a schematic side view of the split chamber of FIG. 7.

In order to prevent overheating on the housing 74 and the non-heating zone 76 of the hotplate 70, a split wind-tunnel chamber 82 may be provided in the hotplate 70, as shown in FIGS. 7 and 8. The split wind-tunnel chamber 82 defines an upper hot wind tunnel 84 and a lower cold wind tunnel 86. The upper hot wind tunnel 84 is located adjacent to the downside of the heating zone 72 where the heat element of the present application is provided. A fan 88 is employed to blow hot air out of the heating apparatus 70 through the upper hot wind tunnel 84 as shown by the arrows.

With the split wind-tunnel chamber 82, hot air and cold air are separated in the hotplate 70. Airflow generated by the fan 88 can blow out hot air through the upper hot wind tunnel 84, and effectively remove excessive heat and reduce the temperature inside the hotplate 70 and on its housing 74. A drop of 15° C. to a temperature below 40° C. on the housing 74 and non-heating zone 76 of the hotplate 70, which utilizes the nano-thickness heating element of the present application, can be achieved with the split wind-tunnel chamber 82, which otherwise is not allowed for practical use of the hotplate.

Figure 9:
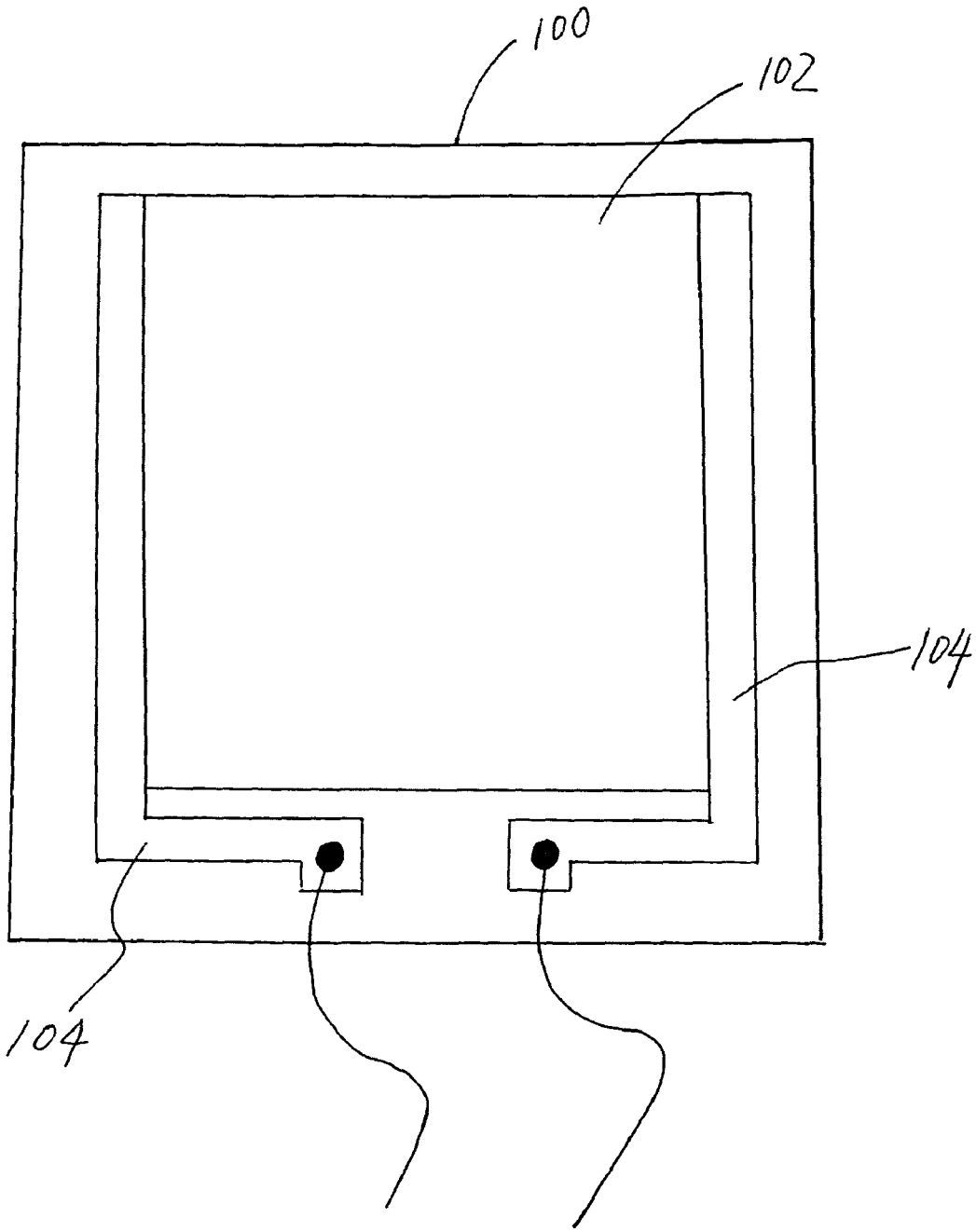
FIG. 9 is a schematic diagram of a ceramic tile coated with the multi-layer nano-thickness heating film.

The multi-layer coating of nano-thickness disclosed in the present application can be applied on other substrate materials including but not limited to ceramics tiles and plate glasses for driveway and roof defrosting, wall, floor and house warming, clothing and shoes warming in cold weather. A multi-layered nano-thickness conductive coating 102 may be bonded on a ceramic tile 100, as shown in FIG. 9, by the controlled spraying process described hereinbefore. A pair of electrodes 104 can also be formed by the process described in the present application. On a heating element with a coated area of 150 mm×150 mm, effective resistances of about 2000 ohms can be achieved and provide power outputs of about 25 W.

The multi-layer coating of nano-thickness disclosed in the present application can be applied in automotives industry including but not limited to engine heating for easy starting, panel, mirror and wind shields heating and defrosting in cold weather.

The multi-layer coating of nano-thickness disclosed in the present application can also be applied in aviation industry including but not limited to aeroplane wings and cockpit heating and defrosting in cold weather condition.

The coating system of the present application is capable of integration with a.c., d.c. power supply and/or solar energy system for heat generating functions. Conventional heating elements are often of high electrical resistance, electrical current is hence low under d.c. power and incapable of generating sufficient energy uniformly over an area for heating and cooking. Improvement of conductivity and reduction of electrical resistance of the heating films, through controlled spray process, to 10 ohms or below can be achieved. It is capable of generating sufficient energy over an area to perform practical heating functions using d.c. power supply and/or be integrated with solar energy power supply. Using a 24V d.c. power supply, the heating element described in this application is able to reach a temperature of 150° C. in less than 2 minutes with sufficient energy to perform heating, cooking and warming functions. With 12V d.c. power supply, it is capable of reaching a temperature of 150° C. in less than 8 minutes.

With a heating apparatus using a.c. power supply, fast and efficient heating functions up to about 600° C. with low power loss can be performed. It can be used in heating apparatus including but not limited to cooktops, hotplates, heaters and defrosting and warming devices. It helps to save electricity consumption by almost 30% due to its high energy efficiency, and provides significant benefits in minimizing pollution and global warming to the environment, and also helps consumers to greatly reduce their electricity bills.

On cooktop and hotplate applications, fast and efficient heating comparable and outperforming the current induction heating technology can be produced. As compared to induction heating, the heating element of the present application imposes no magnetic radiation and interference (magnetic induction used in induction heating), and is low in material cost (expensive copper coil used in induction heating). Furthermore, the coating materials and the method disclosed in the present application are low in cost, and have no restriction on cooking utensils (only high grade stainless steel utensils can perform well with induction heating). The heating apparatus of the present application is light-weight and has a versatile design.

While the heating apparatus and the method of forming a heating element of a heating apparatus disclosed in the present application has been shown and described with particular references to a number of preferred embodiments thereof, it should be noted that various other changes or modifications may be made without departing from the scope of the appended claims.

What is claimed is:

1. A heating apparatus including a heating element adapted to be disposed on a substrate, the heating element comprising:

electrodes;

a multi-layer conductive coating of about 50 nm to about 70 nm each layer in thickness disposed between the substrate and electrodes; and a multi-layer insulating coating disposed between the multi-layer conductive coating and the substrate.

2. The heating apparatus as claimed in claim 1, wherein the multi-layer conductive coating comprises an oxide coating including a source metal selected from the group consisting of tin, indium, cadmium, tungsten, titanium and vanadium.

3. The heating apparatus as claimed in claim 1, wherein the electrodes comprises glass ceramic frit based ink including a source metal selected from the group consisting of platinum, gold, silver, palladium and copper.

4. The heating apparatus as claimed in claim 1, wherein each layer of the multi layer insulating coating is about 30 nm to about 50 nm in thickness.

5. The heating apparatus as claimed in claim 1, wherein the multi-layer insulating coating comprises sol-gel derived silicon dioxide.

6. The heating apparatus as claimed in claim 1, further comprising a surfactant on the substrate, the surfactant comprising perfluoralkyl surfactant of a concentration between about 0.01 and about 0.001% w/w with sodium dioctyl sulphosuccinate of a concentration between 0.1 and about 0.01% w/w.

7. The heating apparatus as claimed in claim 1, further comprising a temperature monitor and control system integrated with the heating element of the heating apparatus, the temperature monitor and control system comprising an analog-to-digital converter for measuring temperature and a pulse-width modulation drive for regulating power supply.

8. A heating apparatus including a heating element adapted to be disposed on a substrate, the heating element comprising:

electrodes;

a multi-layer conductive coating of about 50 nm to about 70 nm each layer in thickness disposed between the substrate and electrodes, the multi-layer conductive coating produced by spray pyrolysis; and a multi-layer insulating coating disposed between the multi-layer conductive coating and the substrate.

9. The heating apparatus as claimed in claim 8, wherein the spray pyrolysis is carried out at a temperature of about 650° C. to about 750° C.

10. The heating apparatus as claimed in claim 8, wherein the spray pyrolysis is carried out at a spray pressure of about 0.4 MPa to about 0.7 MPa.

11. The heating apparatus as claimed in claim 8, wherein the spray pyrolysis is carried out at a spray head speed of less than 1000 mm per second.

12. The heating apparatus as claimed in claim 8, wherein the spray pyrolysis is carried out by alternating spray passes in a direction of about 90 degrees to each other.

13. The heating apparatus as claimed in claim 8, wherein the electrodes are disposed on the conductive coating by screen printing.

14. The heating apparatus as claimed in claim 8, wherein each layer of the multi layer insulating coating is about 30 nm to about 50 nm in thickness.

15. The heating apparatus as claimed in claim 8, wherein the multi-layer insulating coating is disposed on the substrate by dip coating, using tetra ethoxy ortho silicate as a base precursor, and each layer of the multi-layer insulating coating is hydrolysed, dried and fired at about 500° C.

16. The heating apparatus as claimed in claim 8, further comprising a temperature monitor and control system integrated with the heating element of the heating apparatus, the temperature monitor and control system comprising an analog-to-digital converter for measuring temperature and a pulse-width modulation drive for regulating power supply.

17. A method of making a heating element of a heating apparatus, the method comprising the steps of:

providing a substrate;

disposing a multi-layer insulating coating on the substrate;

producing a multi-layer conductive coating of about 50 nm to about 70 nm each layer in thickness by spray pyrolysis on the multi-layer insulating coating; and disposing electrodes on the conductive coating.

18. The method of making a heating element of a heating apparatus as claimed in claim 17, wherein each layer of the multi-layer insulating coating is about 30 nm to about 50 nm in thickness.

* * * * *